US006993143B2

(12) United States Patent
Harris et al.

(10) Patent No.: US 6,993,143 B2
(45) Date of Patent: Jan. 31, 2006

(54) FOLDABLE HEADPHONES

(75) Inventors: David Harris, Nashua, NH (US); Rudy Woodard, Boston, MA (US); Vian Li, Kowloon (HK); Baird Little, Nashua, NH (US)

(73) Assignee: Brookstone Purchasing, Inc, Merrimack, NH (US)

( * ) Notice: Subject to any disclaimer, the term of this patent is extended or adjusted under 35 U.S.C. 154(b) by 6 days.

(21) Appl. No.: 10/658,560

(22) Filed: Sep. 8, 2003

(65) Prior Publication Data

US 2005/0053255 A1 Mar. 10, 2005

(51) Int. Cl.
*H04R 25/00* (2006.01)

(52) U.S. Cl. ..... 381/379; 381/374; 381/383

(58) Field of Classification Search ..... 381/370, 381/374, 376, 377, 378, 379, 381, 383, 71.6, 381/72; 2/209; 379/430; 181/129
See application file for complete search history.

(56) References Cited

U.S. PATENT DOCUMENTS

| | | | | |
|---|---|---|---|---|
| 3,532,837 | A | 10/1970 | Dyar et al. | 179/156 |
| D266,244 | S | 9/1982 | Hofer et al. | D14/36 |
| 4,404,434 | A | 9/1983 | Pelt et al. | 179/156 R |
| 4,409,442 | A | 10/1983 | Kamimura | 179/156 R |
| 4,445,005 | A | 4/1984 | Furuhashi | 179/156 R |
| 4,571,746 | A | 2/1986 | Gorike | 2/209 |
| 4,597,469 | A | 7/1986 | Nagashima | 181/129 |
| 4,609,786 | A | 9/1986 | Omoto et al. | 179/156 R |
| D287,008 | S | 12/1986 | Tragatschnig | D14/36 |
| D351,597 | S | 10/1994 | Nakamura | D14/205 |
| D405,449 | S | 2/1999 | Nakmura et al. | D14/205 |
| 6,130,953 | A | 10/2000 | Wilton et al. | 381/375 |
| 6,385,325 | B1 | 5/2002 | Nageno et al. | 381/374 |

FOREIGN PATENT DOCUMENTS

| | | |
|---|---|---|
| JP | 2000-125386 | 4/2000 |

OTHER PUBLICATIONS

"PXC 250, Exclusive Noise Gard, active noise reduction" by Sennheiser (1 pg).

*Primary Examiner*—Huyen Le
(74) *Attorney, Agent, or Firm*—Nixon Peabody LLP

(57) ABSTRACT

A system and method for a collapsible headphone unit is provided. Generally, the system contains a first extendable sidepiece and a second extendable sidepiece, both rotatably attached to a top member. The first extendable sidepiece is attached to a first earpiece, and the second extendable sidepiece is attached to a second earpiece. Each earpiece has an open portion that fits against the ear of the user. The first and second extendable sidepieces may be extended, thereby allowing the first and second earpieces to pivot, resulting in the open portions of the first and second earpieces being directly opposed, and allowing the first and second earpieces and the first and second extendable sidepieces to fold upward toward the top member.

23 Claims, 3 Drawing Sheets

FOLDABLE HEADPHONES

FIELD OF THE INVENTION

The present invention is generally related to headphones, and more particularly is related to headphones that may be folded.

BACKGROUND OF THE INVENTION

Technology has enabled a decrease in size of many categories of audio devices including, but not limited to, Compact Disc (CD) and Moving Pictures Experts Group-audio layer 3 (MP3) players, thereby making portability of such devices both feasible and desirable. It is equally desirable that headphones utilized in association with these audio devices be small for ease of portability.

Currently, headphones incorporate different combinations of pivot points, extensions, and beam and hinge configurations to allow for folding. Certain foldable headphones contain a central pivot point located on a headband at a point corresponding to a top portion of the head of a user. This configuration typically uses an additional pivot point at each earpiece, or the earpieces are mounted on slideable extensions. An example of headphones that have a central pivot point with an additional pivot point at each earpiece is provided by U.S. Pat. No. 6,385,325, issued May 7, 2002, to Koji Nageno (herinafter "Nageno"). Generally, Nageno provides "collapsible" headphones having earpieces that fold inward towards the headband, while the headband folds in on itself. Unfortunately, the earpieces of Nageno are not protected from damage that may be provided by exterior elements and/or conditions.

Another example of foldable headphones is provided by U.S. Pat. No. 4,409,442, issued Oct. 11, 1983, to Tomohiko Kamimura (hereinafter "Kamimura"). Generally, Kamimura provides foldable headphones that contain a central pivot point and slideable extensions. In addition, Kamimura provides earpieces that are fully retracted on extensions, towards the headband, and the headband is folded in on itself.

Foldable headphones may also have a beam and hinge configuration. An example of such headphones is provided by U.S. Pat. No. 4,609,786, issued Sep. 2, 1986, to Hideo Omoto (herinafter "Omoto"). Generally, Omoto provides earpieces that roll inside the headband in a coiled fashion. Unfortunately, once again, the earpieces of Omoto are not protected from exterior elements and/or conditions. Variations of these configurations suffer similar disadvantages, specifically, unprotected earpieces, minimal foldability, or both.

Thus, a heretofore unaddressed need exists in the industry to address the aforementioned deficiencies and inadequacies.

SUMMARY OF THE INVENTION

Embodiments of the present invention provide a foldable headphone unit and method for folding the headphone unit. Briefly described, one embodiment of the invention, among others, can be implemented as follows. The foldable headphone unit has a first extendable sidepiece and a second extendable sidepiece, both rotatably attached to a top member. The first extendable sidepiece is attached to a first earpiece, and the second extendable sidepiece is attached to a second earpiece. Each earpiece has an open portion that fits against the ear of the user. The first and second extendable sidepieces may be extended, thereby allowing the first and second earpieces to pivot, resulting in the open portions of the first and second earpieces being directly opposed, and allowing the first and second earpieces and the first and second extendable sidepieces to fold upward toward the top member.

The present invention can also be viewed as providing methods for folding a foldable headphone unit. In this regard, one embodiment of such a method, among others, can be broadly summarized by the following steps: extending first and second sidepieces; rotating a first yoke assembly towards an inner portion of the first sidepiece; rotating a second yoke assembly toward an inner portion of the second sidepiece; and pivoting the first and second earpieces, resulting in opposed positioning of the open portions of the earpieces.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
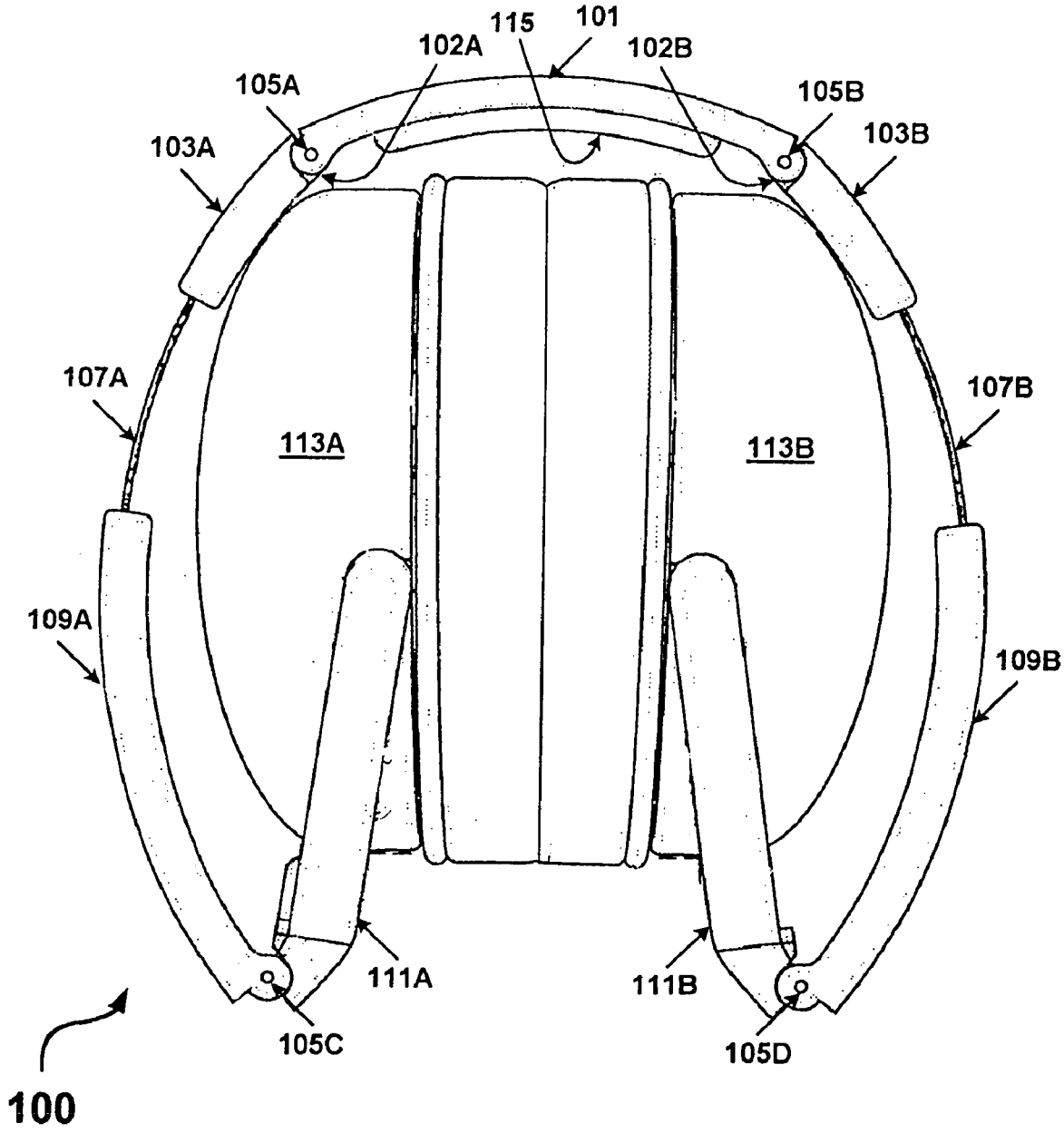
FIG. 1 is a front view of a headphone unit in a folded configuration, in accordance with a first exemplary embodiment of the invention.

FIG. 1 is a front view of a headphone unit 100 in a folded configuration, in accordance with a first exemplary embodiment of the invention. As is shown by FIG. 1, a first end of a top member 101 is rotatably coupled to a first end of a first upper-side member 103A via a first connecting pin 105A. Specifically, when the headphone unit 100 is being folded, the first connecting pin 105A and the top member 101 allow the first upper-side member 103A to rotate inward towards a lower surface of the top member 101. When the headphone unit 100 is being unfolded for use, the first connecting pin 105A and the top member 101 allow the upper-side member 103A to rotate outward, away from the lower surface of the top member 101, to form the generally arcuate shape defined by the headphone unit 100, but prevent further outward rotation.

Similarly, a second end of the top member 101 is rotatably coupled to a first end of a second upper-side member 103B via a second connecting pin 105B. Rotation of the second upper-side member 103B is similar to the rotation of the first upper-side member 103A previously described. One of ordinary skill in the art will appreciate that the connecting pins 105A, 105B may be replaced by any other device that provides rotation capability between the top member 101 and the upper-side members 103A, 103B. The connecting pins may be replaced by, as an example, but not limited to, ball and joint mechanisms.

A first end of a generally arcuate first extension band 107A is fixedly coupled internal to the first upper-side member 103A at an approximate midpoint of the first upper-side member 103A. Similarly, a first end of a generally arcuate second extension band 107B is fixedly coupled to the second upper-side member 103B. One of ordinary skill in the art will appreciate that coupling between the upper-side member 103A, 103B and the extension band 107A, 107B may be achieved by any method or apparatus providing a fixed coupling, internal or external, between the upper-side member 103A, 103B and the extension band 107A, 107B. The coupling may be achieved by, as an example, but not limited to, welding, bonding, or bolting the upper-side member 103A, 103B to the extension band 107A, 107B.

A second end of the first extension band 107A passes through a slot in a first end of a first lower-side member 109A, and is slideably coupled internally to the first lower-side member 109A, the coupling forming a frictional fit between the first lower-side member 109A and the first extension band 107A. Similarly, a second extension band 107B is slideably coupled to a second lower-side member 109B. The lower-side members 109A, 109B may be extended away from the upper-side members 103A, 103B, or retracted towards the upper-side members 103A, 103B along the slideably coupled extension bands 107A, 107B. Further, the frictional fit holds the lower-side members 109A, 109B in an extended or retracted position as required by the user for folding or use of the headphone unit 100. One of ordinary skill in the art will appreciate that the slideable coupling between the extension bands 107A, 107B and the lower-side members 109A, 109B may be made internally or externally to the lower-side members 109A, 109B, and may be achieved by any method, including, but not limited to, opposing frictional surfaces, or a detent arrangement.

Figure 3:
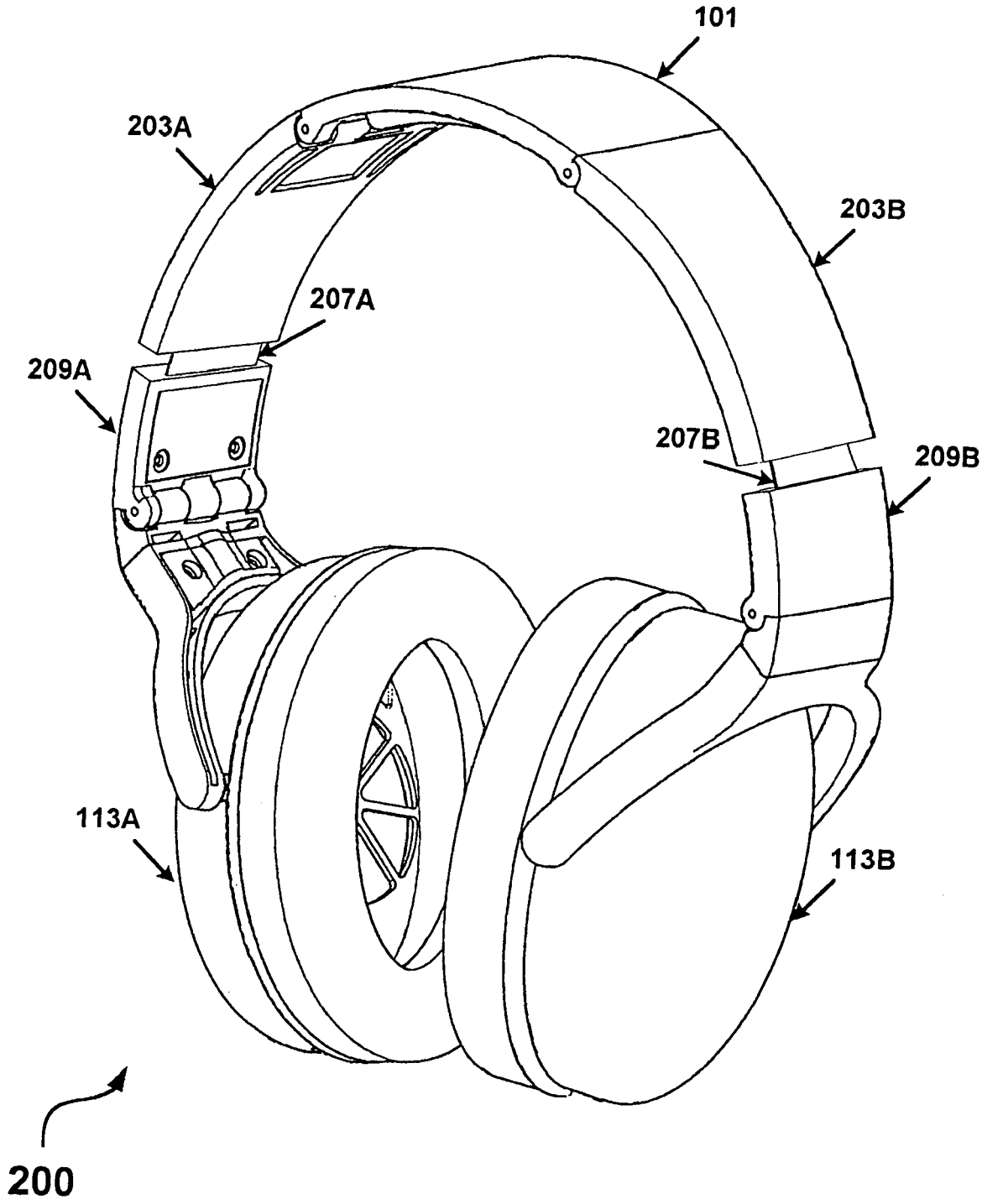
FIG. 3 is an illustration of the headphone unit of FIG. 1 in accordance with a second exemplary embodiment of the invention, where the headphone unit is in an unfolded configuration.

Alternatively, in accordance with a second exemplary embodiment of the headphone unit 200 shown in FIG. 3, a first end of a generally arcuate extension band 207A, 207B is slideably coupled internally to an upper-side member 203A, 203B, and a second end of the extension band 207A, 207B is fixedly coupled to a lower-side member 209A, 209B. In this second exemplary embodiment, the top member 101 and the upper-side members 203A, 203B may be extended away from the lower-side members 209A, 209B, or be retracted towards the lower-side members 209A, 209B along the slideably coupled extension bands 207A, 207B. One of ordinary skill in the art will appreciate that the above-described methods of providing fixed coupling and slideable coupling between the extension bands 207A, 207B, the upper-side members 203A, 203B, and the lower-side members 209A, 209B apply similarly to this second exemplary embodiment of the invention. FIG. 3 is further described below.

Returning to FIG. 1, the top member 101, upper-side members 103A, 103B, extension bands 107A, 107B, and lower-side members 109A, 109B may be made of a resilient material, for example, but not limited to, plastic, and define a generally arcuate shape.

A second end of the first lower-side member 109A is rotatably coupled to a first end of a first yoke assembly 111A via a third connecting pin 105C. Specifically, when the headphone unit 100 is being folded, the third connecting pin 105C and the first lower-side member 109A allow the first yoke assembly 111A to rotate upward towards an inner surface of the first lower-side member 109A. When the headphone unit 100 is being unfolded for use, the third connecting pin 105C and the first lower-side member 109A allow the first yoke assembly 111A to rotate downward, away from the inner surface of the first lower-side member 109A, to form the generally arcuate shape defined by the headphone unit 100, but prevent further outward rotation. Similarly, a second end of a second lower-side member 109B is rotatably coupled to a first end of a second yoke assembly 111B via a fourth connecting pin 105D. One of ordinary skill in the art will appreciate that the connecting pins 105C, 105D may be replaced by any other device that provides rotation capability between the lower-side members 109A, 109B and the yoke assemblies 111A, 111B. The connecting pins 105C, 105D may be replaced by, as an example, but not limited to, ball and joint mechanisms.

A second forked end of the yoke assembly 111A, 111B has a dimension sufficient to accommodate coupling to an earpiece 113A, 113B. Each earpiece 113A, 113B has an open portion 117A, 117B (FIG. 2) capable of transmitting sound to the ear of the user. Padding, 116A, 116B (FIG. 2), for example, but not limited to, closed-cell foam, is attached to the open portion 117A, 117B of the earpiece 113A, 113B that is placed against the ear of the user to provide user comfort. The earpiece 113A, 113B is coupled approximately at its horizontal centerline to pivot points on the second end of the yoke assembly 111A, 111B, allowing the earpiece 113A, 113B to fully rotate through the yoke assembly 111A, 111B. One of ordinary skill in the art will appreciate that the coupling may be achieved by any method or apparatus providing full rotation of the earpiece 113A, 113B through the yoke assembly 111A, 111B, including, but not limited to, a shaft, or ball and joint configuration.

In addition to allowing the earpiece 113A, 113B to pivot in the vertical plane, the yoke assembly 111A, 111B also provides for rotation of the earpiece 113A, 113B in the horizontal plane via a shaft (not shown) that axially couples the first end of the yoke assembly 111A, 111B to the second end of the yoke assembly 111A, 111B. One of ordinary skill in the art will appreciate that the shaft may be replaced by any other device that provides rotation capability between the first end of the yoke assembly 111A, 111B and the second end of the yoke assembly 111A, 111B. The shaft may be replaced by, as an example, but not limited to, a ball and joint mechanism. Rotation of the earpieces 113A, 113B in the horizontal plane provides a comfortable fit for the user during use, and provides proper alignment of the opposed earpieces 113A, 113B in the folded configuration.

A pad 115 made of a material including, but not limited to, open-cell foam, covering a substantial length and width of a lower surface of the top-member 101, is provided for user comfort. Additionally, the pad 115 provides increased clearance between coupling points 102A, 102B of the top member 101 to the upper-side members 103A, 103B, and the head of the user, thereby preventing discomfort associated with the coupling points 102A and 102B coming into contact with the head of the user.

In the folded configuration of the first exemplary embodiment of the headphone unit 100 shown in FIG. 1, the extension bands 107A, 107B are extended, thereby allowing the earpieces 113A, 113B to pivot in the yoke assemblies 111A, 111B such that the open portions 117A, 117B of the earpieces 113A, 1133B are opposed as the yoke assemblies 111A, 111B are folded upward. Folding the headphone unit 100 in this manner provides protection for the sensitive components inside the earpieces 113A, 113B against exterior elements and/or conditions. When the headphone unit 100 is unfolded for use, the earpieces 113A, 113B may be properly positioned over the ears of the user by extending or retracting the lower-side members 109A, 109B.

Figure 2:
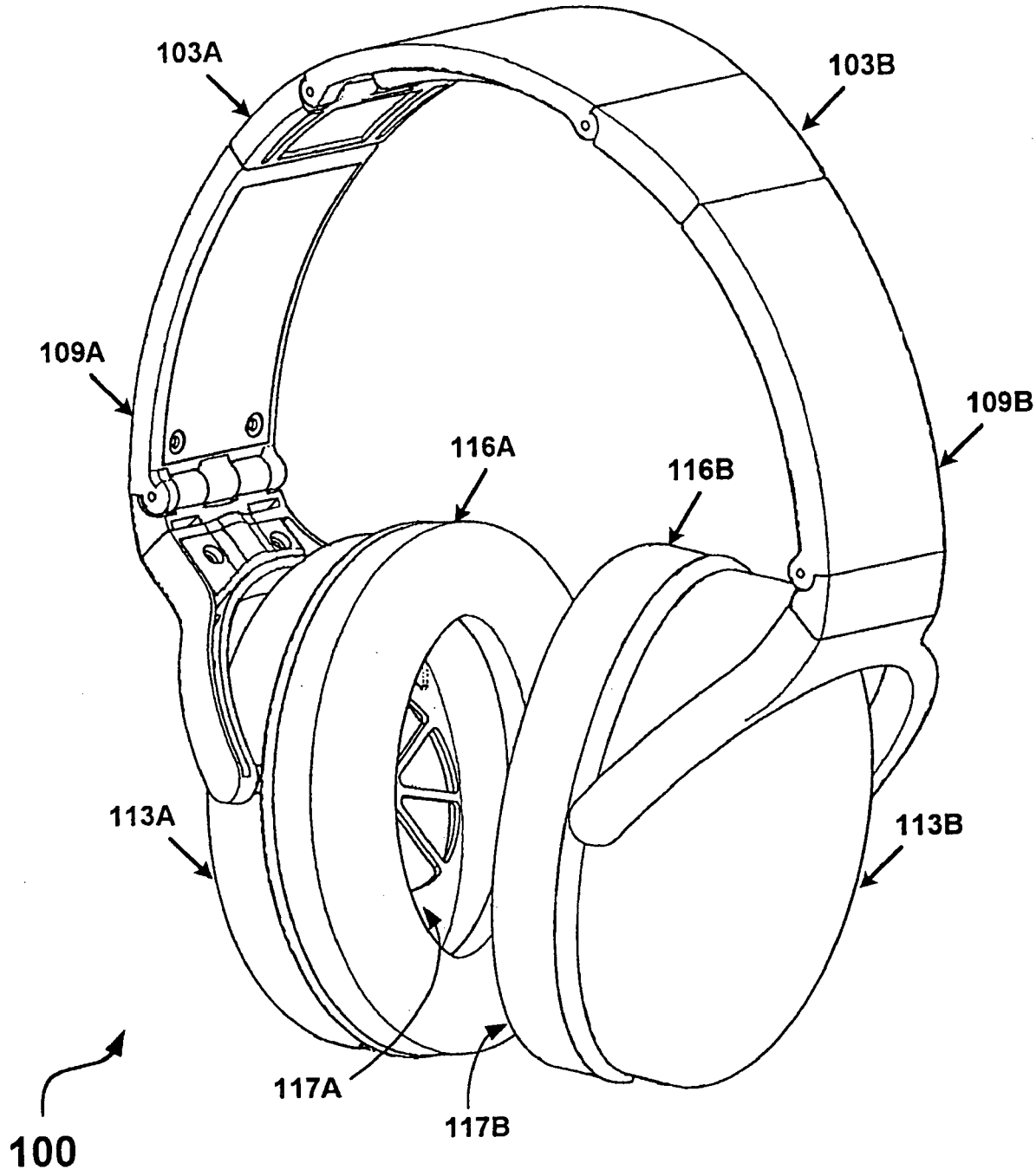
FIG. 2 is an illustration of the headphone unit of FIG. 1 in an unfolded configuration.

FIG. 2 is an illustration of the headphone unit 100 of FIG. 1 in an unfolded configuration, with the upper-side members 103A, 103B fixedly coupled to the extension bands 107A, 107B. The extension bands 107A, 107B are slideably coupled to lower-side members 109A, 109B that are longer to accommodate the length of the extension bands 107A, 107B as they are retracted into the lower-side members 109A, 109B.

Continuing with the description of FIG. 3 from above, FIG. 3 is an illustration in accordance with a second exemplary embodiment of the headphone unit 200, where the headphone unit 200 is in an unfolded configuration. In the second exemplary embodiment of the headphone unit 200, the upper-side members 203A, 203B are longer to accommodate the length of the extension bands 207A, 207B as they are retracted into the upper-side members 203A, 203B. The lower-side members 209A, 209B, alternatively, are fixedly coupled to the extension bands 207A, 207B. It should be noted that a third exemplary embodiment of the headphone unit may also be provided where the upper-side members 103A, 103B and the lower-side members 109A, 109B have the same length.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A foldable headphone unit, comprising:

a top-member;

a first extendable sidepiece coupled to said top member about a first rotatable connection;

a second extendable sidepiece coupled to said top member about a second rotatable connection, wherein said first rotatable connection is spaced from said second rotatable connection along said top member;

a first earpiece coupled to said first extendable sidepiece, said first earpiece comprising at least one open portion; and a second earpiece coupled to said second extendable sidepiece, said second earpiece comprising at least one open portion, wherein said first and second extendable sidepieces may be extended, thereby allowing said first and second earpieces to pivot, resulting in said open portions of said first and second earpieces being directly opposed, and allowing said first and second earpieces and said first and second extendable sidepieces to fold upward toward said top member.

2. The foldable headphone unit of claim 1, further comprising a padding material coupled to an underside of said top member, said padding material substantially covering said underside.

3. The foldable headphone unit of claim 2, wherein said padding material has a thickness sufficient to provide clearance between a first coupling means that couples said first extendable sidepiece to said top member and said head of said user, and a second coupling means that couples said second extendable sidepiece to said top member and said head of said user.

4. The foldable headphone unit of claim 1, wherein said first extendable sidepiece comprises a first upper-side member, a first extension band, first lower-side member, and a first yoke assembly, and wherein said second extendable sidepiece comprises a second upper-side member, a second extension band, a second lower-side member, and a second yoke assembly.

5. The collapsible headphone according to claim 4, wherein said first yoke assembly has a first end rotatably coupled to a second end of said first lower-side member; and wherein said second yoke assembly has a first end rotatably coupled to a second end of said second lower-side member, whereby said first and second yoke assemblies may be rotated axially with respect to said first and second lower-side members.

6. The collapsible headphone unit of claim 5, wherein said first yoke assembly further comprises a second end having a forked shape with a dimension sufficient to accommodate coupling to said first earpiece, allowing said earpiece to pivot within dimension of said forked shape, and wherein said second yoke assembly further comprises a second end having a forked shape with a dimension sufficient to accommodate coupling to said second earpiece, allowing said second earpiece to pivot within dimension of said forked shape.

7. The foldable headphone unit of claim 1 wherein said top member further comprises an elongated, one-piece member with said first and second rotatable connections located adjacent opposing ends of said elongated, one-piece member.

8. A foldable headphone unit, comprising:

a top-member;

a first extendable sidepiece coupled to said top member;

a second extendable sidepiece coupled to said top member;

a first earpiece coupled to said first extendable sidepiece, said first earpiece comprising at least one open portion; and a second earpiece coupled to said second extendable sidepiece, said second earpiece comprising at least one open portion, wherein said first and second extendable sidepieces may be extended, thereby allowing said first and second earpieces to pivot, resulting in said open portions of said first and second earpieces being directly opposed, and allowing said first and second earpieces and said first and second extendable sidepieces to fold upward toward said top member, wherein said first extendable sidepiece comprises a first upper-side member, a first extension band, first lower-side member, and a first yoke assembly, and wherein said second extendable sidepiece comprises a second upper-side member, a second extension band, a second lower-side member, and a second yoke assembly, wherein a first end of said first extension band is fixedly coupled to said first upper-side member, wherein a second end of said first extension band is slideably coupled to said first lower-side member, said first lower-side member being longer than said first upper-side member, whereby said first lower-side member may be extended and retracted along said first extension band, wherein a first end of said second extension band is fixedly coupled to said second upper-side member, and wherein a second end of said second extension band is slideably coupled to said second lower-side member, said second lower-side member being longer than said second upper-side member, whereby said second lower-side member may be extended and retracted along said second extension band.

9. A foldable headphone unit, comprising:

a top-member;

a first extendable sidepiece coupled to said top member;

a second extendable sidepiece coupled to said top member;

a first earpiece coupled to said first extendable sidepiece, said first earpiece comprising at least one open portion; and a second earpiece coupled to said second extendable sidepiece, said second earpiece comprising at least one open portion, wherein said first and second extendable sidepieces may be extended, thereby allowing said first and second earpieces to pivot, resulting in said open portions of said first and second earpieces being directly opposed, and allowing said first and second earpieces and said first and second extendable sidepieces to fold upward toward said top member, wherein said first extendable sidepiece comprises a first upper-side member, a first extension band, first lower-side member, and a first yoke assembly, and wherein said second extendable sidepiece comprises a second upper-side member, a second extension band, a second lower-side member, and a second yoke assembly, wherein a first end of said first extension band is slideably coupled to said first upper-side member, said first upper-side member being longer than said first lower-side member, whereby said first upper-side member may be extended and retracted along said first extension band, wherein a second end of said first extension band is fixedly coupled to said first lower-side member, wherein a first end of said second extension band is slideably coupled to said second upper-side member, said second upper-side member being longer than said second lower-side member, whereby said second upper-side member may be extended and retracted along said second extension band, and wherein a second end of said second extension band is fixedly coupled to said second lower-side member.

10. A method of folding a headphone unit, wherein said headphone unit comprises a top member, a first extendable sidepiece, a second extendable sidepiece, a first yoke assembly, a second yoke assembly, a first earpiece comprising at least one open portion, and a second earpiece comprising at least one open portion, said method comprising the steps of:

extending said first and second sidepieces;

rotating said first yoke assembly towards an inner portion of said first sidepiece;

rotating said second yoke assembly towards an inner portion of said second sidepiece;

pivoting said first and second earpieces, resulting in opposed positioning of said open portions of said earpieces;

rotating said first extendable sidepiece coupled to said top member about a first rotatable connection; and rotating said second extendable sidepiece coupled to said top member about a second rotatable connection, wherein said first rotatable connection is spaced from said second rotatable connection along said top member.

11. The method of claim 10, further comprising the step of retracting said first and second sidepieces towards said top member.

12. The method of claim 10, wherein said first extendable sidepiece further comprises a first upper-side member, a first extension band, and a first lower-side member, and.

wherein said second extendable sidepiece further comprises a second upper-side member, a second extension band, and a second lower-side member.

13. The method of claim 12, wherein said step of extending said first and second sidepieces further comprises the steps of:

extending said first upper-side member along said first extension band; and extending said second upper-side member along said second extension band.

14. The method of claim 13, wherein a first end of said first extension band is slideably coupled to said first upper-side member, said first upper-side member being longer than said first lower-side member, wherein a second end of said first extension band is fixedly coupled to said first lower-side member, wherein a first end of said second extension band is slideably coupled to said second upper-side member, said second upper-side member being longer than said second lower-side member, and wherein a second end of said second extension band is fixedly coupled to said second lower-side member.

15. The method of claim 12, further comprising the step of retracting said first and second upper-side members towards said top member.

16. The method of claim 12, wherein said step of extending said first and second sidepieces further comprises the steps of:

extending said first lower-side member along said first extension band; and extending said second lower-side member along said second extension band.

17. The method of claim 16, further comprising the step of retracting said first and second side members toward said top member.

18. The method of claim 16, wherein a first end of said first extension band is fixedly coupled to said first upper-side member, wherein a second end of said first extension band is slideably coupled to said first lower-side member, said first lower-side member being longer than said first upper-side member, wherein a first end of said second extension band is fixedly coupled to said second upper-side member, and wherein a second end of said second extension band is slideably coupled to said second lower-side member, said second lower-side member being longer than said second upper-side member.

19. The method of claim 10 wherein said top member further comprises an elongated, one-piece member with said first and second rotatable connections located adjacent opposing ends of said elongated, one-piece member.

20. A headphone unit, comprising:

a top-member;

a first upper-side member connected to a first portion of said top-member via a first means for connecting, wherein said first means for connecting comprises a first rotatable connection between said first upper-side member and said top-member;

a second upper-side member connected to a second portion of said top-member via a second means for connecting, wherein said second means for connecting comprises a second rotatable connection between said second upper-side member and said top-member, wherein said first rotatable connection is spaced from said second rotatable connection along said top-member;

a first lower-side member slidably connected to said first upper-side member via a third means for connecting;

a second lower-side member slidably connected to said second upper-side member via a fourth means for connecting;

a first yoke assembly rotatably coupled to said first lower-side member via a fifth means for connecting wherein said first yoke assembly may be rotated axially with respect to said first lower-side member; and a second yoke assembly rotatably coupled to said second lower-side member via a sixth means for connecting, wherein said second yoke assembly may be rotated axially with respect to said second lower-side member wherein a portion of said first yoke assembly has a forked shape having a dimension sufficient to accommodate coupling to a first earpiece, allowing said first earpiece to pivot within dimension of said forked shape, and wherein a portion of said second yoke assembly has a forked shape having a dimension sufficient to accommodate coupling to a second earpiece, allowing said second earpiece to pivot within dimension of said forked shape.

21. The foldable headphone unit of claim 20 wherein said top member further comprises an elongated, one-piece member with said first and second rotatable connections located adjacent opposing ends of said elongated, one-piece member.

22. The headphone unit of claim 20 further comprising:

a first extension band; and a second extension band;

wherein a first end of said first extension band is fixedly coupled to said first upper-side member, wherein a second end of said first extension band is slideably coupled to said first lower-side member, said first lower-side member being longer than said first upper-side member, whereby said first lower-side member may be extended and retracted along said first extension band, wherein a first end of said second extension band is fixedly coupled to said second upper-side member, and wherein a second end of said second extension band is slideably coupled to said second lower-side member, said second lower-side member being longer than said second upper-side member, whereby said second lower-side member may be extended and retracted along said second extension band.

23. The headphone unit of claim 20 further comprising:

a first extension band; and a second extension band;

wherein a first end of said first extension band is slideably coupled to said first upper-side member, said first upper-side member being longer than said first lower-side member, whereby said first upper-side member may be extended and retracted along said first extension band, wherein a second end of said first extension band is fixedly coupled to said first lower-side member, wherein a first end of said second extension band is slideably coupled to said second upper-side member, said second upper-side member being longer than said second lower-side member, whereby said second upper-side member may be extended and retracted along said second extension band, and wherein a second end of said second extension band is fixedly coupled to said second lower-side member.

* * * * *